US005312705A

United States Patent [19]

Tsuchiya et al.

[11] Patent Number: 5,312,705

[45] Date of Patent: * May 17, 1994

[54] PHOTOSENSITIVE MATERIALS FOR ELECTROPHOTOGRAPHY HAVING A DOUBLE-LAYER STRUCTURE OF A CHARGE GENERATION LAYER AND A CHARGE TRANSPORT LAYER

[75] Inventors: Sohji Tsuchiya, Kanagawa; Atsushi Omote, Kawasaki; Mutsuaki Murakami, Tokyo, all of Japan

[73] Assignee: Matsushita Electric Industrial Co., Ltd., Osaka, Japan

[ * ] Notice: The portion of the term of this patent subsequent to Feb. 11, 2009 has been disclaimed.

[21] Appl. No.: 736,671

[22] Filed: Jul. 26, 1991

[30] Foreign Application Priority Data

Jul. 27, 1990 [JP] Japan ..... 2-199401
Sep. 3, 1990 [JP] Japan ..... 2-233509

[51] Int. Cl.[5] ..... G03G 15/02

[52] U.S. Cl. ..... 430/58; 430/57; 430/78

[58] Field of Search ..... 430/58, 57, 78

[56] References Cited

U.S. PATENT DOCUMENTS 3,357,989 12/1967 Byrne et al. .
4,507,374 3/1985 Kakuta et al. ..... 430/58
4,755,443 7/1988 Suzuki et al. .
4,865,934 9/1989 Ueda et al. ..... 430/59
5,087,540 2/1992 Murakami et al. ..... 430/58

FOREIGN PATENT DOCUMENTS 0093331 11/1983 European Pat. Off. .

OTHER PUBLICATIONS

"Patent Abstracts of Japan" vol. 12, No. 401 (P-776)(3248) Oct. 25, 1988 & JP-A-63 142 356 (Seiko Epson Corp) Jun. 14, 1988 *abstract*.

*Primary Examiner*—Marion E. McCamish
*Assistant Examiner*—Mark A. Chapman
*Attorney, Agent, or Firm*—Lowe, Price, LeBlanc & Becker

[57] ABSTRACT

A photosensitive material for electrophotography which comprises a conductive support, and a charge transport layer and a charge generation layer formed on the conductive support, is described. The charge generation layer is formed from a dispersion which is obtained by mixing X-type and/or $\tau$-type metal-free phthalocyanine, with or without at least one other charge generation agent, and a resin binder in a solvent, which is capable of dissolving at least a part of X-type and/or $\tau$-type metal-free phthalocyanine, to such an extent that a ratio between X-ray diffraction peak intensities at about 7.5° and at about 9.1° is in the range of 1:1 to 0.1:1. When the at least one other charge generation agent is used in combination, the charge generation layer is formed on the conductive support on which the charge transport layer is formed. If such other agent is not used, the charge generation layer is formed on the charge transport layer with a certain thickness. The photosensitive materials have good photosensitivity, image characteristics and printing resistance.

9 Claims, 2 Drawing Sheets

PHOTOSENSITIVE MATERIALS FOR ELECTROPHOTOGRAPHY HAVING A DOUBLE-LAYER STRUCTURE OF A CHARGE GENERATION LAYER AND A CHARGE TRANSPORT LAYER

BACKGROUND OF THE INVENTION

1. Field of the Invention

This invention relates to the art of electrophotography and more particularly, to photosensitive materials which have a double-layer structure of a charge generation layer and a charge transport layer and which are particularly suitable for use in an electrophotographic process including charging, exposing and developing operations to form images.

2. Description of the Prior Art

Organic photoconductive conductors using organic photoconductive materials have a number of advantages over inorganic photoconductive conductors, including the ease in preparation of a variety of materials exhibiting high sensitivity at different wavelengths depending on the molecular design, little or no ecological problem, good productivity and economy, and inexpensiveness. Accordingly, extensive studies have been hitherto made on such organic conductors. Some organic conductors are in use and, at present, are being mainly employed as photosensitive materials for electrophotography.

Known organic photoconductive conductors are usually arranged to have a double-layer structure which includes a charge generation layer capable of absorbing light to generate carriers and a charge transport layer wherein the generated carriers are transported. Many attempts have been made to higher sensitivity. Known organic conductive materials used to form the charge generation agent include various perylene compounds, various phthalocyanine compounds, thiapyrylium compounds, anthanthrone compounds, squalilium compounds, bisazo compounds, trisazo pigments, azulenium compounds and the like.

On the other hand, the materials developed to form the charge transport layer include various hydrazone compounds, oxazole compounds, triphenylmethane compounds, arylamine compounds and the like.

The charge generation and transport agents are, respectively, coated along with polymer binders by relatively simple coating techniques on supports such as drums, belts and the like. Examples of the binders used for this purpose include polyester resins, polycarbonate resins, acrylic resins, acryl-styrene resins and the like. In order to attain high sensitivity by the use of the double-layer structure, it is general that the charge generation layer is applied in a thickness of 0.1 to 1 micrometer and the charge transport layer is applied in a thickness of 10 to 20 micrometers. From the standpoint of the physical strength and the printing resistance, the charge generation layer is formed directly on the substrate and the charge transport layer is formed as a surface layer. In this arrangement, charge transport agents which are now in use are those which act by movement of positive holes. Thus, the known photosensitive materials are eventually of the negative charge type.

The negative charge systems, however, have involved the problem that images are apt to suffer the influence of a support surface. For instance, if an aluminium drum is used, impurities and especially, inorganic metal impurities inevitably contained in the aluminium and irregularities on the surface influence the image quality. More particularly, such impurities or irregularities reflect on image defects such as white and/or black spot defects on images. This becomes more pronounced under high temperature and high humidity conditions. Thus, satisfactory image characteristics cannot be obtained.

Such influences may be mitigated by use of highly pure drum materials, by mirror finish of the drum or by application of an undercoating on the drum, with an increase in production costs. Of these, the undercoating technique is considered to be most suitable. However, a difficulty is involved in an increase of residual potential.

In order to solve the above problems, there is known a positive charge system wherein the charge generation layer and the charge transport layer are superposed in a reverse order as of the case of a negative charge system. However, this positive charge system should be very thin in the charge generation layer as set forth before. This leads to poor mechanical strength and a poor printing resistance. Thus, the known positive charge system has a little utility in practical applications. If a protective layer is formed on the charge generation layer, the printing resistance may be improved but a residual potential will be increased with a lowering of environment resistance.

SUMMARY OF THE INVENTION

It is accordingly an object of the invention to provide a photosensitive material for electrophotography which has good image characteristics with high sensitivity and a good printing resistance.

It is another object of the invention to provide a photosensitive material for electrophotography which has a double-layer structure including a charge generation layer and a charge transport layer wherein the charge generation layer contains X-type and/or $\tau$-type metal-free phthalocyanine at least partially in a molecular state.

It is a further object of the invention to provide a photosensitive material for electrophotography which may be either of the positive charge type or of the negative charge type.

In accordance with one embodiment of the invention, there is provided a photosensitive material for electrophotography which comprises a conductive support, and a charge transport layer and a charge generation layer formed on the conductive support in this order, the charge generation layer having a thickness of from 10 to 50 micrometers and being formed from a dispersion which is obtained by mixing X-type and/or $\tau$-type metal-free phthalocyanine and a resin binder in a solvent, which is capable of dissolving at least a part of X-type and/or $\tau$-type metal-free phthalocyanine, to such an extent that a ratio between X-ray diffraction peak intensities at about 7.5° and at about 9.1° is in the range of 1:1 to 0.1:1. By the mixing, at least a part of X-type and/or $\tau$-type metal-free phthalocyanine is mixed with the resin binder in a molecular form or may be converted into a new crystal form as will be discussed hereinafter. The conversion of the at least a part of X-type and/or $\tau$-type metal-free phthalocyanine is very effective in attaining high photoconductivity or sensitivity. Accordingly, the charge generation layer which has been conventionally formed as very thin can be made thick as defined above, so that the printing resistance and physical strength are remarkably improved. It will be noted that the photosensitive material of this embodiment is of the positive charge type.

In accordance with another embodiment of the invention, there is provided a photosensitive material which comprises a conductive support, and a charge generation layer and a charge transport layer formed on the conductive support in this order, the charge generation layer being formed from a dispersion which is obtained by mixing X-type and/or $\tau$-type metal-free phthalocyanine and at least one other charge generation agent and a resin binder in a solvent, which is capable of dissolving at least a part of X-type and/or $\tau$-type metal-free phthalocyanine therein, to such an extent that a ratio between X-ray diffraction intensities at about 7.5° and at about 9.1° is in the range of 1:1 to 0.1:1. Although the material of this embodiment is of the negative charge type, the defects on image quality can be fully overcome and, thus, the material has good sensitivity and image characteristics and a good printing resistance. In this embodiment, the at least one other charge generation agent may be either soluble or insoluble in the solvent used. More particularly, it is sufficient that the at least one other charge generation agent may remain in the form of particles in the dispersion.

DETAILED DESCRIPTION AND EMBODIMENTS OF THE INVENTION

The first embodiment of the invention is initially described. In this embodiment, a charge generation layer is formed on a conductive support, on which a charge transport layer is formed.

The conductive support used in both embodiments of the invention is not critical and includes, for example, metal sheets such as Al sheets, and glass, paper or plastic sheets on which a metal is vapor deposited to form a conductive layer. The support may be in the form of drums, belts, sheets and the like.

In the first embodiment, it is essential that the charge generation layer be formed from a dispersion which comprises a dispersion of X-type and/or $\tau$-type metal-free phthalocyanine and a resin binder in a solvent which is capable of dissolving at least a part of X-type and/or $\tau$-type metal-free phthalocyanine. The mixing should be effected to such an extent that the ratio between X-ray diffraction peaks at about 7.5° and at about 9.1° in the range of 1:1 to 0.1:1.

Phthalocyanine compounds are described in detail.

Phthalocyanines are broadly classified into two groups including metallo-phthalocyanines and metal-free phthalocyanines. Typical of known metal-free phthalocyanines (which may be hereinafter referred to simply as $H_2$-Pc) are $\alpha$-type and $\beta$-type phthalocyanines.

Figure 1:
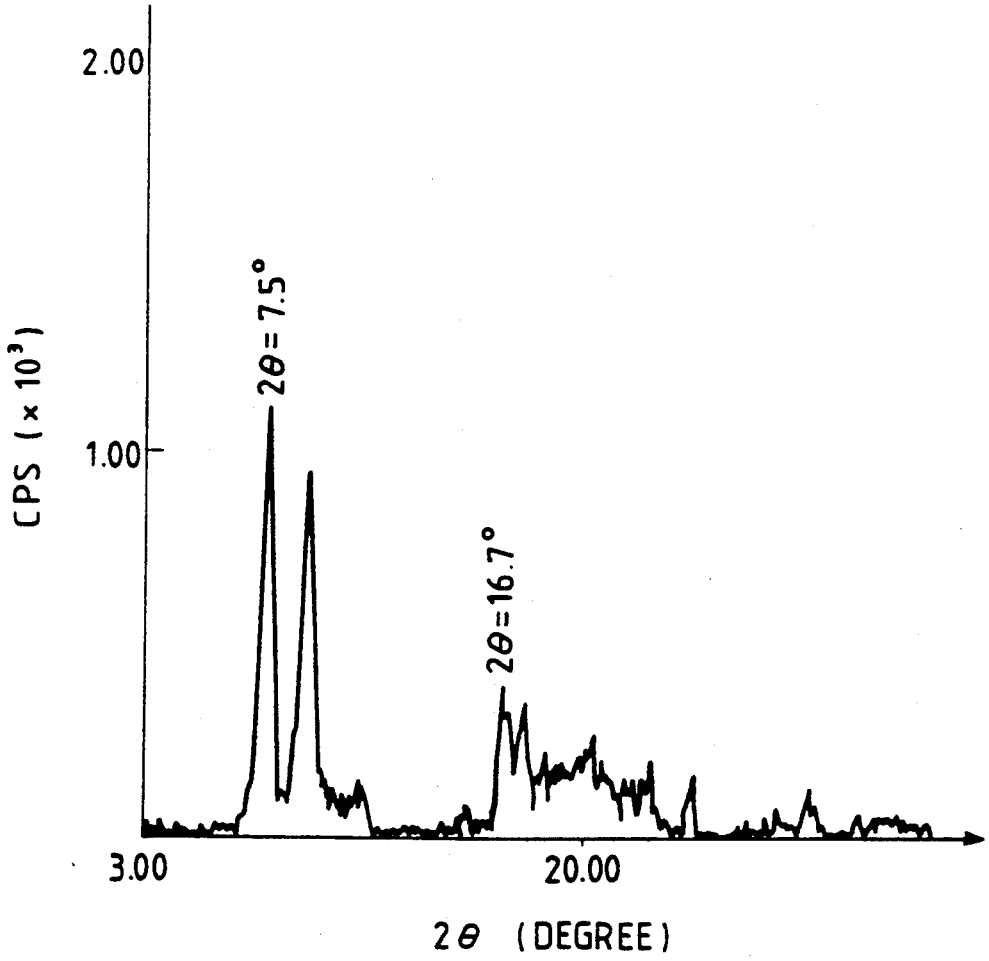
FIG. 1 is an X-ray diffraction pattern of X-type metal-free phthalocyanine.

Xerox Co., Ltd. developed X-type metal-free phthalocyanine and reported as having excellent electrophotographic characteristics. In U.S. Pat. No. 3,357,989, the X-type phthalocyanine is described with respect to its preparation, the relationship between the crystal form and electrophotographic characteristics and the structural analyses. According to this U.S. patent, X-type $H_2$-Pc (phthalocyanine) is prepared by subjecting $\beta$-type $H_2$-Pc prepared by a usual manner to treated with sulfuric acid to obtain $\alpha$-type $H_2$-Pc and then to ball milling over a long time. The crystal structure of X-type $H_2$-Pc is apparently different from those of $\alpha$ or $\beta$-type $H_2$-Pc. According to the X-ray diffraction pattern obtained with use of a CuK $\alpha$ line as shown in FIG. 1, the diffraction lines appear at $2\theta=7.4°$, 9.0°, 15.1°, 16.5°, 17.2°, 20.1°, 20.6°, 20.7°, 21.4°, 22.2°, 23.8°, 27.2°, 28.5° and 30.3°. The most intense diffraction peak appears in the vicinity of 7.5° (corresponding to a lattice spacing, d,=11.8 angstroms). When this intensity is taken as 1, the intensity of the diffraction line in the vicinity of 9.1° (corresponding to a lattice spacing, d,=9.8 angstroms) is 0.66.

Aside from the above crystal forms, $\tau$-type metal-free phthalocyanine is also known. This phthalocyanine is obtained by subjecting to ball milling $\alpha$, $\beta$ or X-type crystals in an inert solvent along with a milling aid at a temperature of 5° to 10° C. for 20 hours. The X-ray diffraction pattern is substantially similar to that of the X type provided that the ratio of the diffraction peak intensity at about 7.5° and the diffraction peak intensity at about 9.1° is 1:0.8.

Figure 2:
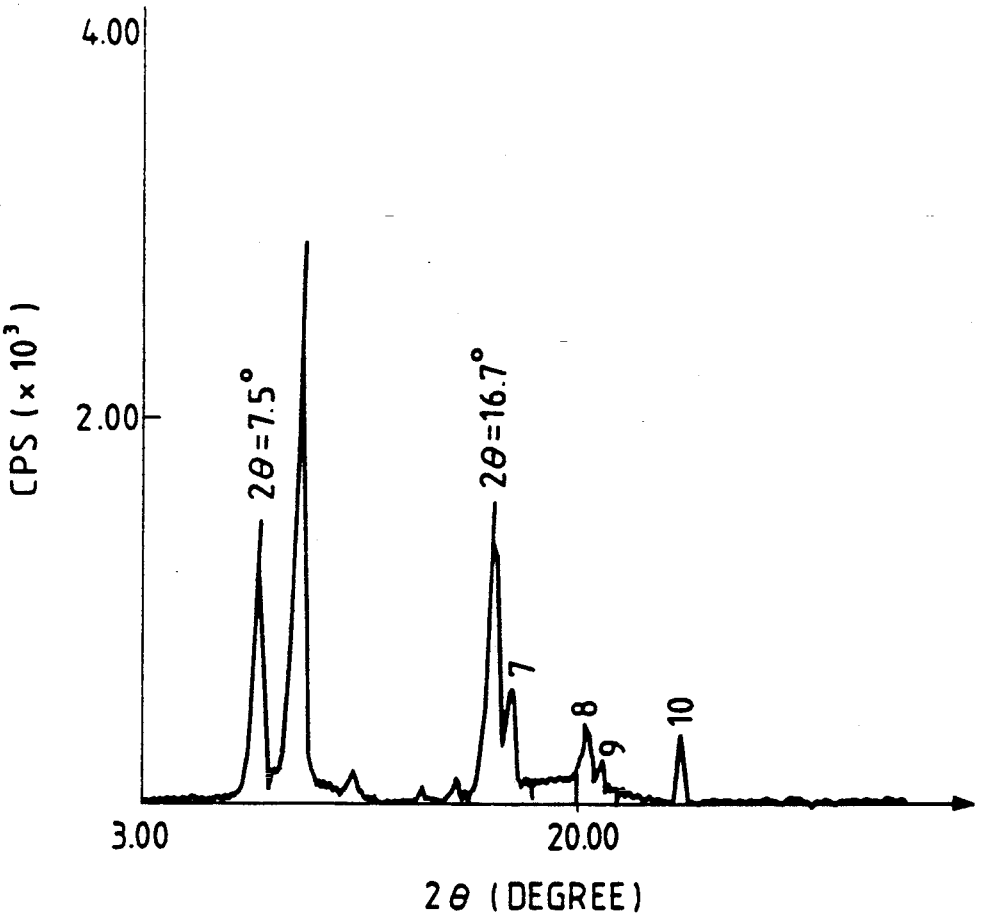
FIG. 2 is an X-ray diffraction pattern of X-type metal-free phthalocyanine after dissolution in a solvent along with a resin binder to a satisfactory extent.

The X-type and/or $\tau$-type metal-free phthalocyanine is added to a solvent along with a resin binder and is dispersed therein under mixing or kneading conditions. In order to obtain a stable solution, it takes about one day or over by ordinary agitation techniques. When the mixing under agitation is effected to a satisfactory extent, the X-type and/or $\tau$-type phthalocyanine becomes finer in size and a part thereof is dissolved in the solvent or the resin solution. The dissolution can be confirmed by an increase of the viscosity of the solution. In this state, the phthalocyanine is considered to exist in the solution partly in a particulately dispersed state and partly in a molecularly dispersed state. The molecularly dispersed phthalocyanine is considered to be different in crystal form from the particulately dispersed phthalocyanine. This molecularly dispersed phthalocyanine is assumed to have the charge transport function. When X-type $H_2$-Pc is used, the X-ray diffraction pattern of the dissolved X-type phthalocyanine is apparently different from that of X-type $H_2$-Pc alone. More particularly, the X-ray diffraction pattern of the molecularly dispersed or dissolved X-type metal-free phthalocyanine shown in FIG. 2 has the tendency that the diffraction lines over $2\theta=21.4$ disappear as compared with a X-ray diffraction pattern of X-type metal-free phthalocyanine per se. The diffraction pattern in the vicinity of 16.5° tends to increase in intensity. The most appreciable variation in the X-ray diffraction pattern is that, of two diffraction lines in the vicinity of 7.5° (d=11.8 angstroms) and 9.1° (d=9.8 angstroms), only the diffraction line in the vicinity of 7.5° is selectively decreased. From this, at least a part of the X-type metal-free phthalocyanine which is considered to be molecularly dispersed in the resin solution is believed to be converted into a new crystal form.

The degree of mixing or kneading, and the mixing time and temperature depend on the type of solvent. In order to obtain good characteristics as a photosensitive material, the degree of the mixing or kneading can be determined by using the ratio between the diffraction pattern intensities in the vicinity of 7.5° and 9.1°, i.e. $I_{11.8}/I_{9.8}$. The ratio should be in the range of from 1:1 to 0.1:1 for both X-type and $\tau$-type phthalocyanines.

The solvents capable of dissolving at least a part of X-type and/or $\tau$-type phthalocyanine include, for example, nitrobenzene, chlorobenzene, dichlorobenzene, dichloromethane, trichloroethylene, chloronaphthalene, methylnaphthalene, benzene, toluene, xylene, tetrahydrofuran, cyclohexanone, 1,4-dioxane, N-methylpyrrolidone, carbon tetrachloride, bromobutane, ethylene glycol, sulforane, ethylene glycol monobutyl ether, acetoxyethoxyethane, pyridine, or the like. The above solvents may be used singly or in combination.

The binder resins used in the present invention should preferably be ones which can be dissolved in the solvents for the phthalocyanine as mentioned above. The binder resins suitable for this purpose include polyesters, polycarbonates, polyacrylates, polyvinyl acetate, polyvinyl chloride, polyvinylidene chloride, polyvinyl butyral, polyvinyl acetoacetal, polystyrene, polyacrylonitrile, polymethyl methacrylate, polyvinyl carbazoles, copolymers of the monomers used in the above-mentioned polymers, vinyl chloride/vinyl acetate/vinyl alcohol terpolymers, vinyl chloride/vinyl acetate/-maleic acid terpolymers, ethylene/vinyl acetate copolymers, vinyl chloride/vinylidene chloride copolymers, melamine resins, alkyd resins, cellulose polymers, various siloxane polymers, and mixtures thereof.

If two or more solvents are used in combination, it is possible to dissolve the phthalocyanine in one solvent and a resin binder in the other solvent. When a given resin binder is used, the dissolution and the variation in the X-ray diffraction pattern of the phthalocyanine may be changed depending on the type of solvent.

As stated hereinabove, X-type metal-free phthalocyanine and a resin binder are dissolved in a solvent and mixed by means of ball mills, attritors, sand grinders or the like for one day or over. The resultant solution is applied onto a conductive support on which a charge transport layer has been formed. The application is carried out, for example, by bar coaters, calender coaters, spin coaters, blade coaters, dip coaters, gravure coaters or the like.

As set out before, it is usual to form a charge generation layer in a thickness of from 0.1 to 2 micrometer. This is because too large a thickness undesirably brings about a lowering of photosensitive characteristics and a lowering of dissolution. In this connection, however, the charge generation layer of the invention obtained from the dispersion or solution mixed in such a manner as stated above exhibits good photosensitive and image characteristics irrespective of the thickness. The thickness of the charge generation layer is generally in the range of from 10 to 50 micrometers, preferably from 20 to 30 micrometers. In this range of the thickness, the printing resistance is good without use of any overcoating layer which would adversely influence the photosensitive and image characteristics.

The X-type and/or $\tau$-type metal-free phthalocyanine and the binder resin should preferably be mixed at a ratio by weight of 1:10 to 1:1.

The charge transport layer formed directly on the conductive support is made of a dispersion of a charge transport agent in a resin binder. This layer serves as a kind of undercoating for the charge generation layer and acts to eliminate the influences of the surface condition of the conductive support. With aluminium drums, for example, metal impurities and/or surface irregularities influence the image quality, resulting in black spot defects or other defects produced on images. In this embodiment, the charge generation layer is formed on the charge transport layer and suffers the influence. As a matter of course, a blocking layer or conductive layer may be provided between the support and the charge generation layer in addition to the charge transport layer.

The charge transport agents may be any known compounds such as various hydrazone compounds, oxazole compounds, triphenylmethane compounds, arylamine compounds and the like, which are ordinarily used for this purpose. Specific examples are those set out in examples. The resin binders may be those used to form the charge generation layer. To prepare a dispersion or solution for the charge transport layer, a charge transport agent and a resin binder are dissolved or dispersed in a solvent for the resin binder. Examples of such binders may be not only those used to form the charge generation layer, but also alcohols such as methanol, ethanol, butanol and the like.

The charge transport layer generally has a thickness of from 5 to 40 micrometers, preferably from 10 to 30 micrometers.

The photosensitive material obtained in this embodiment has a sensitivity as high as from 0.5 to 2.0 lux.-second and exhibits good sensitivity to light with a wide range of wavelength of from 600 to 800 nm. The residual potential is not larger than approximately 30 volts.

The second embodiment of the invention is then described.

In this embodiment, a charge generation layer is formed on a conductive support, on which a charge transport layer is formed contrary to the case of the first embodiment.

The charge generation layer should be formed from a dispersion which comprises X-type and/or $\tau$-type metal-free phthalocyanine and at least one charge generation agent other than X-type and/or $\tau$-type metal-free phthalocyanine and a resin binder. The dispersion is mixed in a manner described with respect to the first embodiment so that at least a part of X-type and/or $\tau$-type metal-free phthalocyanine is dissolved in a solvent but it is not important whether or not the other charge generation agent is dissolved in the solvent. The other charge generation agent may be dissolved or may not be dissolved in the solvent. Accordingly, the solvents and the resin binders used in this embodiment are, respectively, those defined in the first embodiment.

The degree of the mixing is defined by the X-ray diffraction intensities in the vicinity of 7.5° and 9.1° similar to the first embodiment.

The mixing ratio by weight of the X-type and/or $\tau$-type metal-free phthalocyanine and at least one other charge generation agent is in the range of from 0.1:1 to 2:1. The mixing ratio by weight of the total of the X-type and/or $\tau$-type metal-free phthalocyanine and the at least one other charge generation agent and the resin binder is generally in the range of 2:1 to 1:5.

Examples of the at least one other charge generation agents are various phthalocyanine compounds other than X-type and/or $\tau$-type metal-free phthalocyanine, thiapyrillium compounds, anthanthrone compounds, squalilium compounds, bisazo compounds, trisazo pigments, perylene compounds, azulenium compounds and the like known charge generation compounds. The phthalocyanine compounds other than X-type and/or $\tau$-type metal-free phthalocyanine include, for example, $\alpha$-, $\beta$- and $\epsilon$-type metal-free phthalocyanines, and metallo-phthalocyanines such as copper phthalocyanine, lead phthalocyanine, tin phthalocyanine, silicon phthalocyanine, vanadium phthalocyanine, chloroaluminium phthalocyanine, titanyl phthalocyanine, chloroindium phthalocyanine, chlorogallium phthalocyanine and the like.

Of these, charge generation agents which exhibit good sensitivity to visible light, e.g. bisazo compounds and perylene compounds, are preferred.

In this embodiment, the charge generation layer comprising X-type and/or $\tau$-type metal-free phthalocyanine is directly formed on a conductive support of the type as set out in the first embodiment. The thickness of the charge generation layer may be in the range of from 0.1 to 1 micrometer, unlike the first embodiment, although a larger thickness may be used.

When the X-type and/or $\tau$-type metal-free phthalocyanine and other charge generation agents are treated along with a resin binder over a long term, some interaction between X-type and/or $\tau$-type metal-free phthalocyanine and the other charge generation agents may take place to improve the charge and image characteristics. In fact, the X-type and/or $\tau$-type metal-free phthalocyanine at least a part of which is dissolved by the mixing functions to transport charges, which is considered to give good influences on the sensitive characteristics. The charge generation layer formed in this manner is unlikely to suffer adverse influences of metal impurities, for example, in an aluminium drum or the surface irregularities. This is considered to result from the very high sensitivity brought about by the combination of different types of charge generation agents.

The charge transport layer is formed on the charge generation layer. The charge transport layer is one which is described in the first embodiment. The thickness of the layer is generally in the range of from 5 to 40 micrometers, preferably from 10 to 20 micrometers. This is particularly useful in the improvement of the printing resistance.

The photosensitive material according to the second embodiment is of the negative type and exhibits a sensitivity as high as 0.6 to 2.0 lux.second, which is higher than that of known photosensitive materials of the double-layer structure type. The residual potential can be suppressed to not larger than 30 volts.

In this case, a blocking layer or conductive layer may be provided between the charge generation layer and the conductive support. In addition, a protective layer may be provided on the charge transport layer.

The present invention is more particularly described by way of examples. Comparative examples are also shown.

EXAMPLE 1

X-type metal-free phthalocyanine (Fastogen Blue 8120B, made by Dainippon Inks Co., Ltd.) and a polyester used as a binder (Vylon 200, available from Toyobo Co., Ltd.) were dissolved in tetrahydrofuran at a ratio by weight of 1:5, followed by mixing for two days in a ball mill to obtain a solution for charge generation layer. The solution was subjected to measurement of X-ray diffraction pattern, revealing that the ratio of the diffraction line intensities ($I_{11.8}/I_{9.8}$) was 0.7. From this, it was confirmed that this ratio was significantly different from the ratio of starting X-type metal-free phthalocyanine of 1.5.

Separately, a polycarbonate (Iupilon Z, available from Mitsubishi Gas Chem. Co., Ltd.) and 4-dibenzylamino-2-methylbenzoaldehydo-1,1'-diphenylhydrazone (CTC-191, available from Anan Perfume Ind. Co., Ltd.) were dissolved in ethyl alcohol at a ratio by weight of 2:3, followed by agitation over 2 hours to obtain a solution for charge transport layer.

The solution for charge transport layer was initially applied onto an aluminium support in a dry thickness of 20 micrometers and dried at 60° C. for 30 minutes to form a charge transport layer. Thereafter, the solution for charge generation layer was applied onto the transport layer in a dry thickness of 15 micrometers and dried at 80° C. for 2 hours to form a charge generation layer. Thus, a photosensitive material was obtained.

EXAMPLE 2

The general procedure of Example 1 was repeated except that for obtaining the solution for charge transport layer, there was used 1-phenyl-1,2,3,4-tetrahydroquinolin-6-carboaldehydo-1,1'-diphenylhydrazone (CTC-236, available from Anan Perfume Ind. Co., Ltd.) instead of the 4-dibenzylamino-2-methylbenzoaldehydo-1,1'-diphenylhydrazone, thereby obtaining a photosensitive material.

EXAMPLE 3

The general procedure of Example 1 was repeated except that for obtaining the solution for charge transport layer, there was used 9-ethylcarbazol-3-carboxyaldehydo-1-methyl-1-phenylhydrazone (CT-A, available from Anan Perfume Ind. Co., Ltd.) instead of the 4-dibenzylamino-2-methylbenzoaldehydo-1,1'-diphenylhydrazone, thereby obtaining a photosensitive material.

EXAMPLE 4

The general procedure of Example 1 was repeated except that a solution for charge generation layer was obtained by dissolving X-type metal-free phthalocyanine and an acrylic resin used as a binder (Acrydic, available from Dainippon Inks Co., Ltd.) at a mixing ratio by weight of 1:4 in tetrahydrofuran and mixing for two days in a ball mill and that the thickness of the charge generation layer was 20 micrometers, thereby obtaining a photosensitive material.

EXAMPLE 5

The general procedure of Example 2 was repeated except that a solution for charge generation layer was obtained by dissolving X-type metal-free phthalocyanine and an acrylic resin used as a binder (Acrydic, available from dainippon Inks Co., Ltd.) at a mixing ratio by weight of 1:4 in tetrahydrofuran and mixing for two days in a ball mill and that the thickness of the charge generation layer was 20 micrometers, thereby obtain a photosensitive material.

EXAMPLE 6

The general procedure of Example 3 was repeated except that a solution for charge generation layer was obtained by dissolving X-type metal-free phthalocyanine and an acrylic resin used as a binder (Acrydic, available from dainippon Inks Co., Ltd.) at a mixing ratio by weight of 1:4 in tetrahydrofuran and mixing for two days in a ball mill and that the thickness of the charge generation layer was 20 micrometers, thereby obtain a photosensitive material.

EXAMPLE 7

The general procedure of Example 1 was repeated except that there was used, instead of polyester, vinyl chloride/vinyl acetate polymer so that the diffraction line intensity ratio, $I_{11.8}/I_{9.8}$, was controlled in the range of from 0.5 to 0.8, thereby obtaining a photosensitive material and that the mixing ratio of the binder and the phthalocyanine was at a ratio by weight of 1:1 and the binder was initially dissolved in tetrahydrofuran, after which the phthalocyanine was added.

EXAMPLE 8

The general procedure of Example 7 was repeated except that vinyl chloride/vinyl acetate/vinyl alcohol polymer was used as the binder, thereby obtaining a photosensitive material.

EXAMPLE 9

The general procedure of Example 7 was repeated except that vinyl chloride/vinyl acetate/maleic acid polymer was used as the binder, thereby obtaining a photosensitive material.

EXAMPLE 10

The general procedure of Example 7 was repeated except that a polycarbonate was used as the binder, thereby obtaining a photosensitive material.

EXAMPLE 11

The general procedure of Example 7 was repeated except that polystyrene was used as the binder, thereby obtaining a photosensitive material.

EXAMPLE 12

The general procedure of Example 7 was repeated except that polymethyl methacrylate was used as the binder, thereby obtaining a photosensitive material.

COMPARATIVE EXAMPLE 1

The general procedure of Example 4 was repeated except that n-butyl alcohol was used instead of tetrahydrofuran, thereby obtaining a photosensitive material.

n-Butyl alcohol dissolves the acrylic resin but does not dissolve X-type metal-free phthalocyanine, so that the crystal form is not changed but the phthalocyanine is dispersed only in a particulate state.

COMPARATIVE EXAMPLE 2

The general procedure of Example 5 was repeated except that n-butyl alcohol was used instead of tetrahydrofuran, thereby a photosensitive material.

COMPARATIVE EXAMPLE 3

The general procedure of Example 6 was repeated except that n-butyl alcohol was used instead of tetrahydrofuran, thereby obtaining a photosensitive material.

The photosensitive materials obtained in the examples and comparative examples were each subjected to measurement of photosensitivity by the use of Paper Analyzer Model EPA-8100, made by Kawaguchi Denki K. K., in which white light from tungsten was irradiated on the material to measure a photosensitivity by positive charge (half-life exposure, $E_{\frac{1}{2}}$) and also photosensitivity after repetition of 1000 exposure cycles. In addition, a wavelength characteristic in a range of 400 to 1000 nm was also measured. The results are shown in Table 1.

TABLE 1

| Example No. | Charge Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|
| 1 | 910 | 1.2 | 1.2 | 1.6 |
| 2 | 850 | 1.1 | 1.0 | 2.0 |
| 3 | 870 | 1.5 | 1.5 | 1.2 |
| 4 | 950 | 1.5 | 1.5 | 1.4 |
| 5 | 900 | 1.6 | 1.5 | 1.5 |
| 6 | 930 | 1.5 | 1.6 | 1.2 |
| 7 | 950 | 1.8 | 1.8 | 1.2 |
| 8 | 780 | 1.6 | 1.7 | 1.3 |
| 9 | 950 | 1.8 | 2.0 | 1.1 |
| 10 | 700 | 1.5 | 1.5 | 1.5 |
| 11 | 930 | 2.0 | 2.0 | 1.0 |
| 12 | 900 | 1.8 | 1.7 | 1.5 |
| Comparative Example No. | | | | |
| 1 | 850 | 3.9 | 4.0 | 0.5 |
| 2 | 980 | 3.2 | 3.8 | 0.7 |
| 3 | 850 | 3.4 | 3.9 | 0.6 |

The comparison between the results of Examples 4 and 5 and Comparative Examples 1 to 3 reveals that the photosensitive materials of the examples are better in the photosensitivity and the wavelength characteristic. In addition, with the materials of the invention, the photosensitivity after 1000 exposure cycles is substantially the same as the initial photosensitivity with a very good printing resistance.

Moreover, it was confirmed that the photosensitive materials of the examples were substantially free of any image defects such as black spots under high temperature and high humidity conditions.

EXAMPLE 13

X-type metal free-phthalocyanine (Fastogen Blue 8120B, made by Dainippon Inks Co., Ltd.), perylene tetracarboxylic dimethylimide (PTCDMI) and a polyester used as a binder (Vylon 200, available from Toyobo Co., Ltd.) were dissolved in tetrahydrofuran at ratios by weight of 1:1:2, followed by mixing for two days to obtain a solution for charge generation layer.

Separately, a polycarbonate (Iupilon Z, available from Mitsubishi Gas Chem. Co., Ltd.) and 4-dibenzylamino-2-methylbenzoaldehydo-1,1'-diphenylhydrazone (CTC-191, available from Anan Perfume Ind. Co., Ltd.) were dissolved in ethyl alcohol at a ratio by weight of 1:2, followed by agitation over 2 hours to obtain a solution for charge transport layer.

The solution for charge generation layer was initially applied onto an aluminium support by dipping and thermally treated in vacuum at 120° C. for 1 hour to form a 1 micrometer thick charge generation layer. Thereafter, the solution for charge transport layer was applied onto the charge generation layer and dried at 60° C. for 20 minutes to form a 18 micrometer thick charge transport layer. Thus, a photosensitive material was obtained.

The charge generation layer was subjected to measurement of an X-ray diffraction pattern by the use of an X-ray Diffractometer (RAD-B System, available from Rigaku Electric Co., Ltd.) using a CuKα ray.

From the diffraction pattern, the diffraction peak intensity ratio, $I_{11.8}/I_{9.8}$, was 0.8, which was significantly changed from 1.5 of the starting X-type metal-free phthalocyanine.

EXAMPLE 14

The general procedure of Example 13 was repeated except that for obtaining the solution for charge transport layer, there was used 1-phenyl-1,2,3,4-tetrahydroquinolin-6-carboaldehydo-1,1'-diphenylhydrazone (CTC-236) instead of 4-dibenzylamino-2-methylbenzoaldehydo-1,1'-diphenylhydrazone, thereby obtaining a photosensitive material.

EXAMPLE 15

The general procedure of Example 13 was repeated except that for obtaining the solution for charge transport layer, there was used 9-ethylcarbazol-3-carboxyaldehydo-1-methyl-1-phenylhydrazone (CT-A) instead of the 4-dibenzylamino-2-methylbenzoaldehydo-1,1'-diphenylhydrazone, thereby obtaining a photosensitive material.

EXAMPLE 16

The general procedure of Example 1 was repeated except that a solution for charge generation layer was obtained by dissolving X-type metal-free phthalocyanine, 2,7-bis[2-hydroxy-3-(2-chlorophenylcarbamoyl)-1-naphthylazo]-9-fluorene and an acrylic resin used as a binder (Acrydic, available from Dainippon Inks Co., Ltd.) at mixing ratios by weight of 1:1:2 in tetrahydrofuran and mixing, thereby obtaining a photosensitive material.

EXAMPLE 17

The general procedure of Example 16 was repeated except that a solution for charge transport layer was obtained using 1-phenyl-1,2,3,4-tetrahydroquinolin-6-carboaldehydo-1,1'-diphenylhydrazone (CTC-236) instead of 4-dibenzylamino-2-methylbenzoaldehydo-1,1'-diphenylhydrazone, thereby obtaining a photosensitive material.

EXAMPLE 18

The general procedure of Example 16 was repeated except that a solution for charge transport layer was obtained using 9-ethylcarbazol-3-carboxyaldehydo-1-methyl-1-phenylhydrazone (CT-A) instead of the 4-dibenzylamino-2-methylbenzoaldehydo-1,1'-diphenylhydrazone, thereby obtaining a photosensitive material.

EXAMPLE 19

The general procedure of Example 13 was repeated except that X-type metal-free phthalocyanine, 4-p-dimethylaminophenyl-2,6-diphenylthiapyrilium perchlorate and vinyl chloride/vinyl acetate polymer were dispersed or dissolved in tetrahydrofuran at mixing ratios of 1:1:2, followed by sufficient mixing and kneading, thereby obtaining a solution for charge generation layer.

EXAMPLE 20

The general procedure of Example 19 was repeated except that vinyl chloride/vinyl acetate/vinyl alcohol polymer was used as the binder, thereby obtaining a photosensitive material.

EXAMPLE 21

The general procedure of Example 19 was repeated except that vinyl chloride/vinyl acetate/maleic acid polymer was used as the binder, thereby obtaining a photosensitive material.

EXAMPLE 22

The general procedure of Example 19 was repeated except that a polycarbonate was used as the binder, thereby obtaining a photosensitive material.

EXAMPLE 23

The general procedure of Example 19 was repeated except that polystyrene was used as the binder, thereby obtaining a photosensitive material.

EXAMPLE 24

The general procedure of Example 19 was repeated except that polymethyl methacrylate was used as the binder, thereby obtaining a photosensitive material.

In Examples 19 to 24, the kneading treatment was so controlled that the diffraction peak ratio of the phthalocyanine, $I_{11.8}/I_{9.8}$, in the charge generation layer was in the range of from 0.5 to 0.8.

COMPARATIVE EXAMPLE 4

The general procedure of Example 16 was repeated except that n-butyl alcohol was used instead of tetrahydrofuran, thereby obtaining a photosensitive material.

n-Butyl alcohol dissolves the acrylic resin but does not dissolve X-type metal-free phthalocyanine and 2,7-bis[2-hydroxy-3-(2-chlorophenylcarbamoyl)-1-naphthylazo]-9-fluorene, so that the phthalocyanine is dispersed only in a particulate state without any change of the crystal form.

COMPARATIVE EXAMPLE 5

The general procedure of Example 17 was repeated except that n-butyl alcohol was used instead of tetrahydrofuran, thereby obtaining a photosensitive material.

COMPARATIVE EXAMPLE 6

The general procedure of Example 18 was repeated except that n-butyl alcohol was used instead of tetrahydrofuran, thereby obtaining a photosensitive material.

The photosensitive materials obtained in the examples and comparative examples were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also photosensitivity after repetition of 1000 exposure cycles. In addition, a wavelength characteristic in a range of 400 to 1000 nm was also measured. The results are shown in Table 2.

TABLE 2

| | | Photosensitivity | | |
|---|---|---|---|---|
| Example No. | Charge Potential (V) | Initial Half-life Exposure (lux · sec) | Half-life Exposure After 1000 Cycles (lux · sec) | Wavelength Characteristic ($cm^2/\mu J$) |
| 13 | 720 | 0.8 | 0.8 | 1.8 |
| 14 | 750 | 1.0 | 1.0 | 1.9 |
| 15 | 870 | 0.8 | 0.8 | 1.7 |
| 16 | 780 | 0.8 | 0.8 | 1.4 |
| 17 | 820 | 0.9 | 0.9 | 1.2 |
| 18 | 850 | 0.9 | 0.9 | 1.2 |
| 19 | 700 | 1.2 | 1.2 | 1.6 |
| 20 | 680 | 1.1 | 1.1 | 1.6 |
| 21 | 870 | 1.2 | 1.2 | 1.6 |
| 22 | 760 | 0.8 | 0.8 | 1.8 |
| 23 | 800 | 1.3 | 1.3 | 1.6 |
| 24 | 900 | 1.0 | 1.0 | 1.7 |

TABLE 2-continued

| Example No. | Charge Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|
| Comparative Example No. | | | | |
| 4 | 850 | 1.6 | 1.8 | 1.0 |
| 5 | 980 | 2.0 | 2.0 | 0.9 |
| 6 | 850 | 2.0 | 2.2 | 0.8 |

The comparison between the results of Examples 16 to 18 and Comparative Examples 4 to 6 reveals that the photosensitive materials of the examples are better in the photosensitivity and the wavelength characteristic. In addition, with the materials of the invention, the photosensitivity after 1000 exposure cycles is substantially the same as the initial photosensitivity with a very good printing resistance. The good printing resistance could be confirmed through a continuous printing test using 30,000 A4-size paper sheets and the photosensitive material of Example 13. Also, the photosensitive materials of the invention had good image characteristics under high temperature and high humidity conditions.

What is claimed is:

1. A photosensitive material for electrophotography which comprises a conductive support, and a charge transport layer and a charge generation layer formed on the conductive support in this order, said charge generation layer having a thickness of from 10 to 50 micrometers and being formed from a dispersion which is obtained by mixing X-type and/or τ-type metal-free phthalocyanine and a resin binder in a solvent, which is capable of dissolving at least a part of X-type and/or τ-type metal-free phthalocyanine, to such an extent that a ratio between X-ray diffraction peak intensities at about 7.5° and at about 9.1° is in the range of 1:1 to 0.1:1.

2. The photosensitive material according to claim 1, wherein X-type metal-free phthalocyanine is present in said charge generation layer.

3. The photosensitive material according to claim 1, wherein τ-type metal-free phthalocyanine is present in said charge generation layer.

4. The photosensitive material according to claim 1, wherein a mixture of X-type and τ-type metal-free phthalocyanines is present in said charge generation layer.

5. The photosensitive material according to claim 1, wherein a ratio by weight of X-type and/or τ-type metal-free phthalocyanine and the resin binder is in the range of from 2:1 to 1:10.

6. A photosensitive material which comprises a conductive support, and a charge generation layer and a charge transport layer formed on the conductive support in this order, said charge generation layer being formed from a dispersion which is obtained by mixing X-type and/or τ-type metal-free phthalocyanine and at least one other charge generation agent and a resin binder in a solvent, which is capable of dissolving at least a part of X-type and/or τ-type metal-free phthalocyanine therein, to such an extent that a ratio between X-ray diffraction intensities at about 7.5° and at about 9.1° is in the range of 1:1 to 0.1:1.

7. The photosensitive material according to claim 6, wherein said X-type and/or τ-type metal-free phthalocyanine and said at least one other charge generation agent are mixed at a ratio by weight of 0.1:1 to 2:1.

8. The photosensitive material according to claim 6, wherein a ratio between the total of said X-type and/or τ-type metal-free phthalocyanine and said at least one other charge generation agent and said resin binder is in the range of 2:1 to 1:5.

9. The photosensitive material according to claim 6 wherein said charge generation layer has a thickness of from 0.1 to 1 micrometer and said charge transport layer has a thickness of from 5 to 40 micrometers.

* * * * *